US010362810B2

(12) United States Patent
Birkas

(10) Patent No.: US 10,362,810 B2
(45) Date of Patent: Jul. 30, 2019

(54) GARMENT WITH UNIVERSAL FLY

(71) Applicant: Anna Birkas, Ukiah, CA (US)

(72) Inventor: Anna Birkas, Ukiah, CA (US)

( * ) Notice: Subject to any disclaimer, the term of this patent is extended or adjusted under 35 U.S.C. 154(b) by 377 days.

(21) Appl. No.: 15/132,159

(22) Filed: Apr. 18, 2016

(65) Prior Publication Data

US 2017/0295850 A1 Oct. 19, 2017

(51) Int. Cl.
*A41B 9/00* (2006.01)

(52) U.S. Cl.
CPC ..... *A41B 9/00* (2013.01); *A41B 9/001* (2013.01)

(58) Field of Classification Search
CPC ..... A41B 9/001; A41B 9/02; A41B 9/04
See application file for complete search history.

(56) References Cited

U.S. PATENT DOCUMENTS 3,763,866 A * 10/1973 Bienenfeld ..... A41B 9/02 450/134
5,499,404 A * 3/1996 Marchiorello ..... A41B 9/02 2/227
2012/0204325 A1* 8/2012 Todd ..... A41B 9/02 2/404
2013/0291287 A1* 11/2013 Shoemaker ..... A41B 9/008 2/403

FOREIGN PATENT DOCUMENTS

EP 1118277 A1 * 7/2001 ..... A41B 9/02

* cited by examiner

*Primary Examiner* — Tajash D Patel

(57) ABSTRACT

A garment is provided from two separate modular, substantially mirror-imaged portions, such that the torso section of a wearer may be selectively exposed, front or back, by grasping an exposed edge of an out one of the modular portions, pulling that edge to access and edge of the other modular portion, which is then pulled in the opposite direction to expose a portion of either the wearer's lower torso or buttocks region.

15 Claims, 15 Drawing Sheets

GARMENT WITH UNIVERSAL FLY

BACKGROUND OF THE INVENTION

1. Field of the Invention

The present invention in the technical area of garments for human wear, and pertains more particularly to a garment having a unique structure providing for limited access from outside the garment to a wearer's genitalia.

2. Description of Related Art

Garments that cover a user's genitalia are well known, and such garments are known to provide genital access in several ways, such as by buttoned openings, zippered openings and simple fly structures of various sorts. Such access structures typically provide modest use for men, but are not so useful for women, who typically must partially remove a garment to urinate or defecate, for example, and in the process, if an enclosure like a private restroom is not available, the female user is forced to expose more of her anatomy than she might wish. There is therefore a need for a garment constructed to provide modest access to genitalia, that would be useful for both men and women, and would also allow a female user to keep most of her lower body not exposed in activities requiring access to the genitalia.

BRIEF SUMMARY OF THE INVENTION

In an embodiment of the invention a garment is provided, comprising a first modular portion having a substantially tubular first leg enclosure on a first side from a lowermost end up to a crotch position, a first torso portion contiguous with the first leg enclosure, the first torso portion having first front and back regions proceeding upward from the crotch position to a continuous waist circumference, providing a first waist opening, with the first front and back regions ending at first front and back edges at an angle from the crotch position up to just below the waist height, the first front and back edges forming a first side opening from the torso region above the crotch position, and a second modular portion essentially a mirror image of the first modular portion, having a substantially tubular second leg enclosure on a second side from a lowermost end up to the crotch position, a second torso portion contiguous with the second leg enclosure, the second torso portion having second front and back regions proceeding upward from the crotch position to a continuous waist circumference, providing a second waist opening, with the second front and back regions ending at second front and back edges at an angle from the crotch position up to just below the waist height, the second front and back edges forming a second side opening from the torso region above the crotch position. The first modular portion, juxtaposed with the second modular portion by passing the first modular portion down through the second waist opening and the first leg enclosure through the second side opening with the first torso portion inside the second torso portion, aligning the first waist opening inside the second waist opening, provides the garment with leg enclosures for both of a wearer's legs, with a combined torso portion with the second front and back edges of the second side opening exposed, and the first front and back edges of the first side opening covered beneath fabric of the second torso region, enabling the wearer to grasp and pull the exposed second front edge in a first direction toward the first side opening to an extent to expose and grasp a part of the first front edge, and then to pull the first front edge in the opposite direction from the first direction to an extent to then expose a region of the wearers torso, and to also enable the wearer to grasp the exposed second back edge and to pull the exposed second back edge toward the first side opening to an extent to expose and grasp a part of the first back edge, and then to pull the first back edge in the opposite direction to an extent to then expose a region of the wearers buttocks area.

In one embodiment the modular portions are not joined, and are worn as separate juxtaposed portions. Also in one embodiment the modular portions, juxtaposed, are joined along the waist circumference. Also in one embodiment the leg enclosures are full length to about the position of the wearer's ankles. And in one embodiment the garment further comprises an adjustment tie structure joined to one or both of the leg enclosures, the tie structure comprising two side-by-side tubular portions with a cord passing upward through one of the tubular structures, out the top, and down through the other tubular structure, providing a mechanism enabling the wearer to pull up the leg enclosures to a desired height, and to tie the cord to secure the leg enclosures to the wearer's legs.

In one embodiment the adjustment tie structures are joined to the leg enclosures at a height of from about 4 inches to about 6 inches above the lowermost extremity of the leg enclosures. Also in one embodiment the leg enclosures are truncated less than the full length of a wearer's legs. In one embodiment one or both of the modular portions comprise side patches of stretchable material at a wearer's hip in the waist portions, such that pulling the front and back edges of a side opening of a torso section having the side patch, stretches primarily the side patch, and the stretch of the side patch provides force for pulling the front and back edges back their original position when released. In one embodiment the garment further comprises an upper portion extending upward from the waist portion of one or both of the modular portions, the upper portion providing coverage for part of the wearer's torso above the waist are. And in one embodiment the upper portion is contiguous with just one of the modular portions, and provides just a front covering for the wearer's upper torso, leaving the wearer's back exposed. In a further embodiment the upper portion is contiguous with just one of the modular portions, and provides a front and a back covering for the wearer's upper torso. Also in an embodiment separate front and back portions are provided by extensions from one or both of the modular portions. Also in an embodiment the upper portion further comprises one or more pockets with openings for access to the pockets. In one embodiment the upper portion further comprises one or more buttons proximate a top edge. And in one embodiment the upper portion is folded down at the waist height to cover the wearer's lower torso region including at least the buttocks in back of the torso and the upper thigh of the front torso, and the legs are pulled up by the tie mechanisms, with the cord of the tie mechanisms looped over the buttons of the folded-down upper portion and tied, leaving the legs shortened by the distance the tie mechanisms are pulled up.

DETAILED DESCRIPTION OF THE INVENTION

The present invention provides in several embodiments a new garment that provides a universal fly structure that allows users to expose their private anatomy in a minimal manner when performing any activity involving the genitalia, such as urinating, defecating, or sexual access, among other uses.

In several embodiments of the invention there are two modular portions that are substantially mirrored in geometry. This unique structure is best described with reference to FIGS. 1*a*, 1*b*, 2*a* and 2*b*.

Figure 1A:
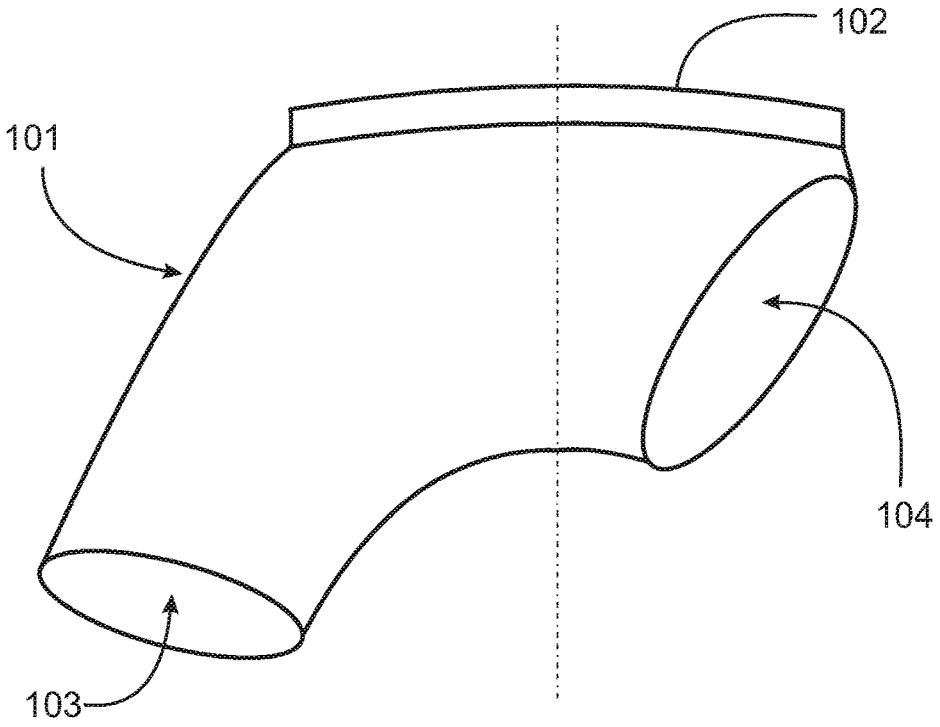
FIG. 1*a* is a perspective view of a portion of a garment in an embodiment of the present invention.

Referring to FIG. 1*a*, a first modular portion 101 of a garment according to an embodiment of the invention is illustrated. Portion 101 has a waist section 102, a body structure with a leg opening 103, and a side opening 104 opposite the leg opening. In this example it is assumed that the views are all in a direction to show the front of the garment and portions of the garment. However, the principle is the same if the views are taken as rear views.

Figure 1B:
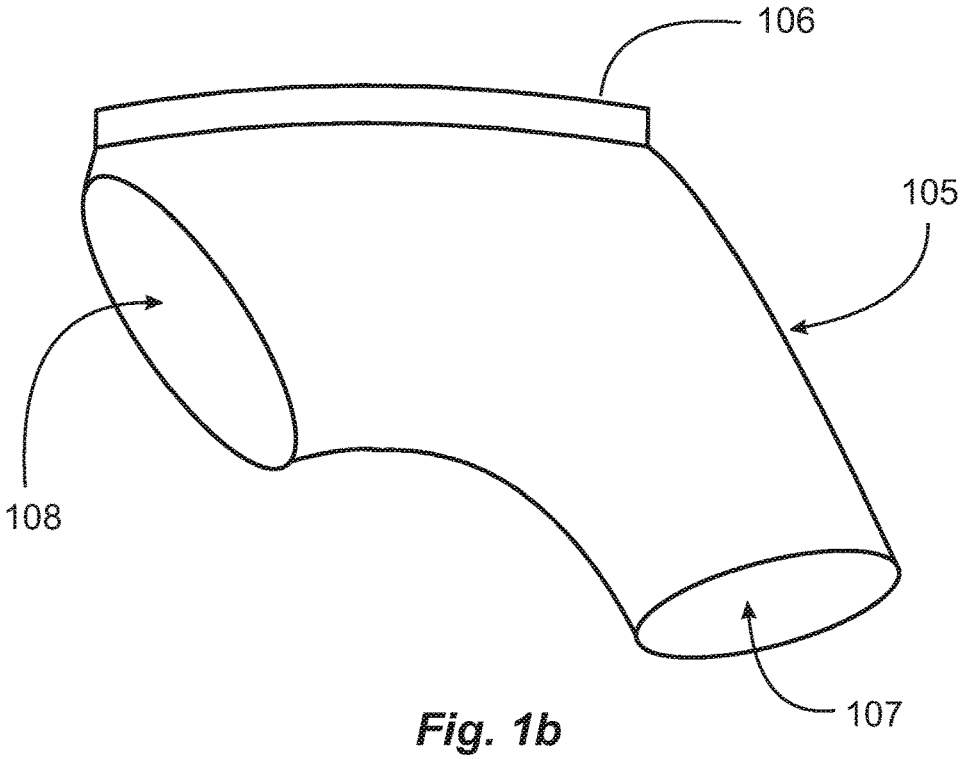
FIG. 1*b* is a perspective view of another portion of a garment according to an alternative embodiment of the invention.

FIG. 1*b* shows a second modular portion 105, which is essentially a mirrored image of portion 101 of FIG. 1*a*. Portion 105 has a waist section 106 essentially the same as waist section 102 of portion 101, a body having a leg opening 107, and a side opening 108 to the opposite side of the leg opening, and facing opposite the side opening 104 of portion 101. These two modular, mirrored portions assembled constitute a single garment according to an embodiment of the invention.

Figure 2A:
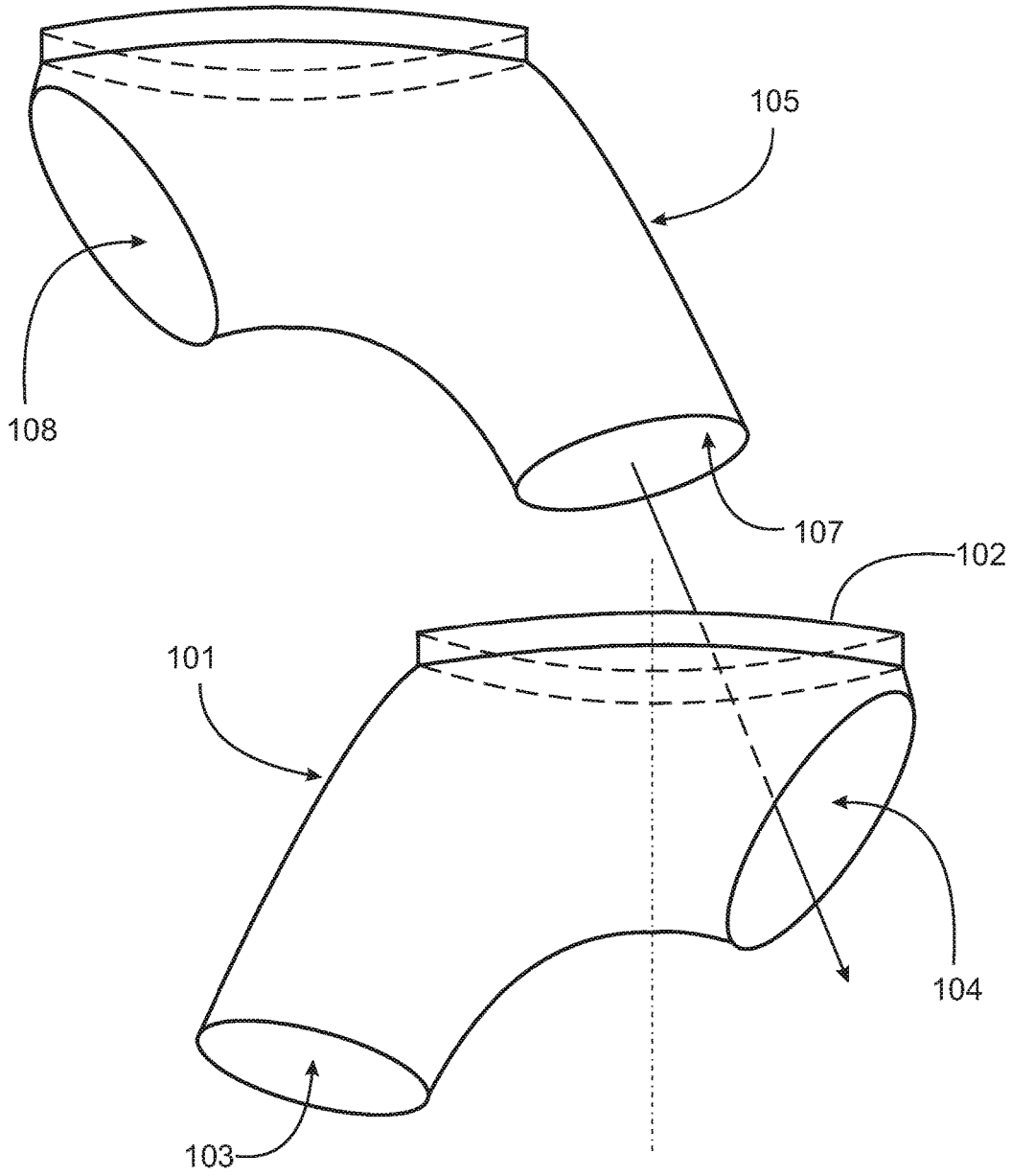
FIG. 2*a* is a perspective view of the garment portion of FIG. 1*b* being assembled to the garment portion of FIG. 1*a*, to make a complete garment according to an embodiment of the invention.

FIG. 2*a* shows the assembly of portions 101 and 105 into a single garment according to an embodiment of the invention. In this example portion 105 is inserted through the waist opening of portion 101, with the leg opening passing through side opening 104 to be again exposed to the outside.

Figure 2B:
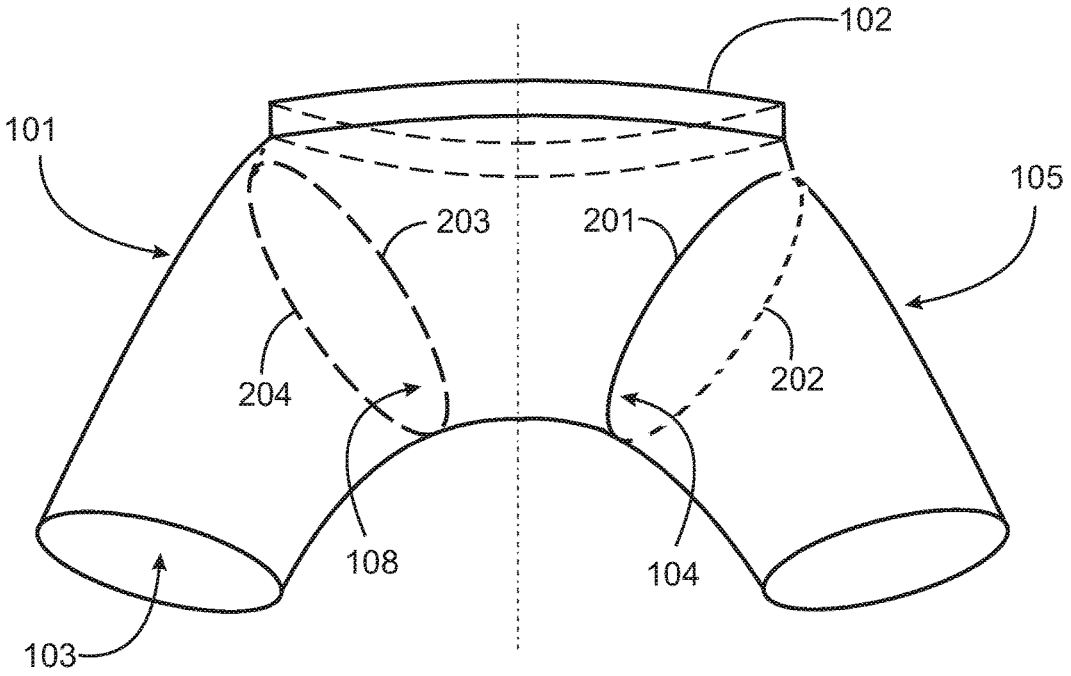
FIG. 2*b* is a perspective view of a garment resulting from the joining of the two portions in FIG. 2*a*.

FIG. 2*b* shows the result of the assembly. The resulting garment may have a single waist opening formed by joining, such as by sewing, the waist sections 102 and 106 of portions 101 and 105. In other embodiments the waist sections are not joined at all, but the two modular portions are separate as worn, but form the functional single garment.

In FIG. 2*b* the front and rear edges of openings 108 and 104 are labeled with element numbers. Opening 104 has a front edge 201 and a rear edge 202. It is important to note that both edges 201 and 202 lie outside the fabric of portion 105, which has leg opening 107, and that these edges are not joined to portion 105. A person wearing this garment could readily insert fingers of one hand under fabric of portion 101, either at edge 201 in the front or edge 202 in the back.

Now referring to edges 203 and 204 of side opening 108, these two edges, 203 to the front and 204 to the back, now lie under the fabric of portion 101, and may not be directly grasped by the wearer of the garment. Further to this description, it should be noted that the parts of the garment over each of a wearer's legs is of a single fabric thickness, but the part covering the front above the crotch, and the back over the user's buttocks, is a double thickness of fabric.

Figure 3A:
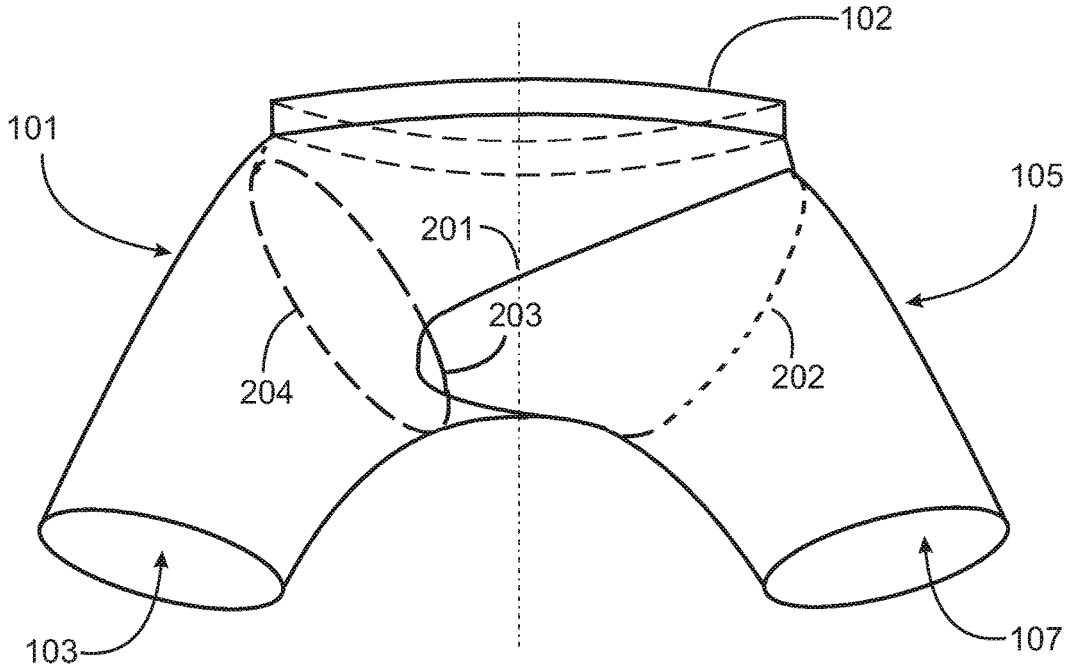
FIG. 3*a* is a perspective view of the garment of FIG. 2*b* in one step of use.

FIG. 3*a* is a front view of the garment of FIG. 2*b* in a particular use. This example assumes a particular flexibility and stretchable nature of the fabric of both modular portions 101 and 105. The fabric used for the modular portions may be a natural or synthetic and have a four-way stretch incorporating a stretch synthetic fiber such as Spandex, Lycra or elastane. Edges 201, 202, 203 and 204 may have additional elastic material incorporated in a sewn seam at the edges. The elastic material may be Latex rubber-band elastic swimwear tape, for example. The In FIG. 3*a* the wearer has grasped edge 201 in the front of the garment, and pulled (stretched) that edge across the front of the garment to just beyond edge 203 of opening 108. This pulling and stretching of edge 201 does not expose the wearer, except for a very small area indicated as 301, because the fabric of portion 105 underneath the fabric of portion 101 still covers the front of the wearer. A small part of edge 203 is now exposed, however, and the wearer can grasp that edge with the other hand, not used to stretch edge 201.

Figure 3B:
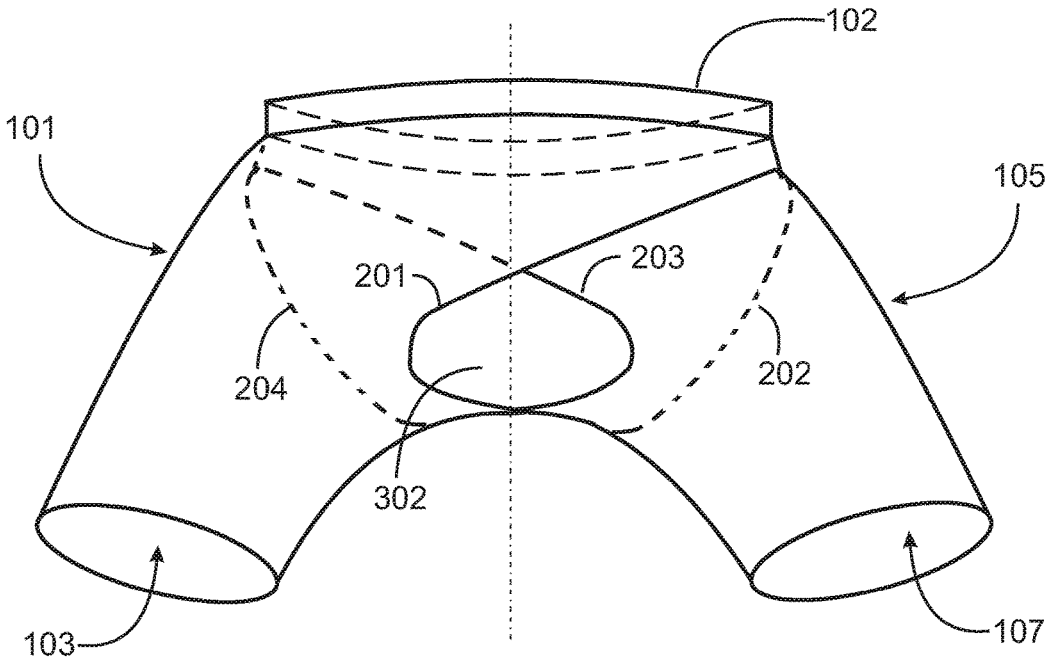
FIG. 3*b* is a perspective view of the garment of FIGS. 2*b* and 3*a* in another step of use.

FIG. 3*b* shows edge 203 stretched toward portion 105 about the same amount as edge 201 was stretched toward portion 101, and this action exposes area 302 of the user's front, and now an area 302 of the wearer's front, beneath both layers of fabric, is exposed. The wearer may perform this operation while seated or squatting to expose the opening of the urethra to urinate. It is important to note that the area exposed is a function of where the wearer grasps the edges, and how far the wearer stretches the edges. A substantially smaller area, or a larger area could have been exposed to include both the genitalia and buttock region of the wearer. An important point is that the wearer has complete control over the exposure, and has no need to remove the garment, use any fasteners such as buttons or a zipper or lower the garment.

Figure 4:
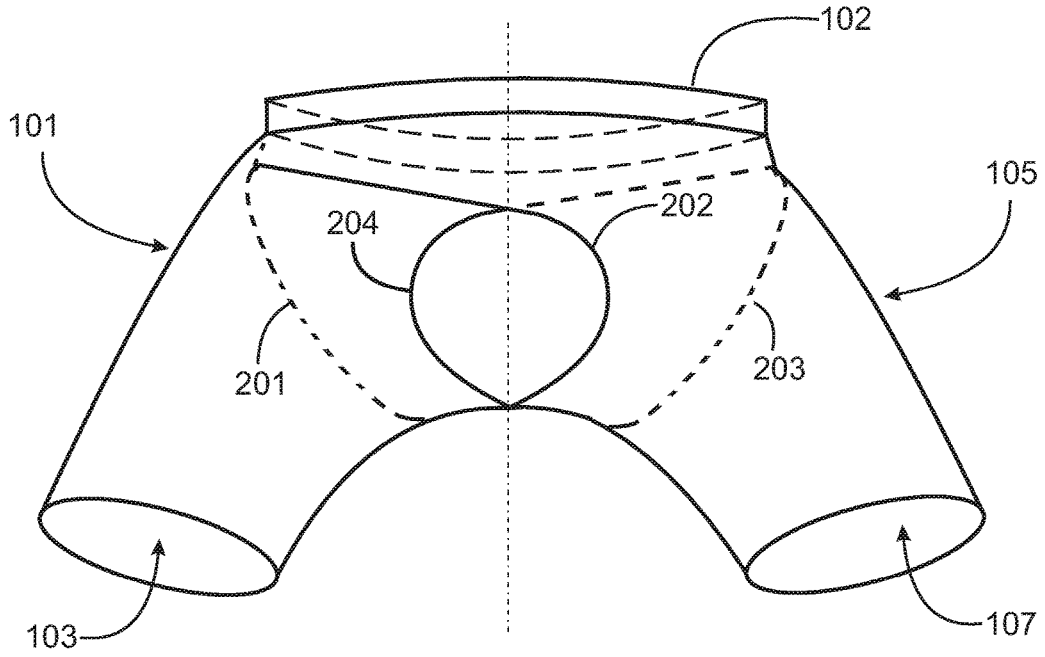
FIG. 4 is a perspective view of the garment of FIGS. 3*a* and 3*b*, seen from the rear, in another step of use.

FIG. 4 is a back view of the garment of FIG. 3*b*, and the user in this example has grasped first the exposed edge 202 and stretched that edge to the opposite side enough to grasp edge 204 with the opposite hand, and stretch that edge in the opposite direction that edge 202 is stretched. In this example the wearer has grasped the edges higher than in the example of FIG. 3*b*, and has exposed the wearer's buttocks (not shown). In a seated or crouched position this operation may be used to expose the anus to defecate. It is important to note that the user could easily have grasped the edges at a different position, and could pull up as well as across, to expose more or less of the wearer's backside.

In alternative embodiments fabric of many different sorts may be used, and certain details may differ, such as the construction of the waist portions. In one embodiment, for example, the waist area of the modular portions may not each encircle the wearer's waist, but each may encircle a portion of the wearer's waist, so that when joined the waist portions provide a complete circumference.

Figure 5A:
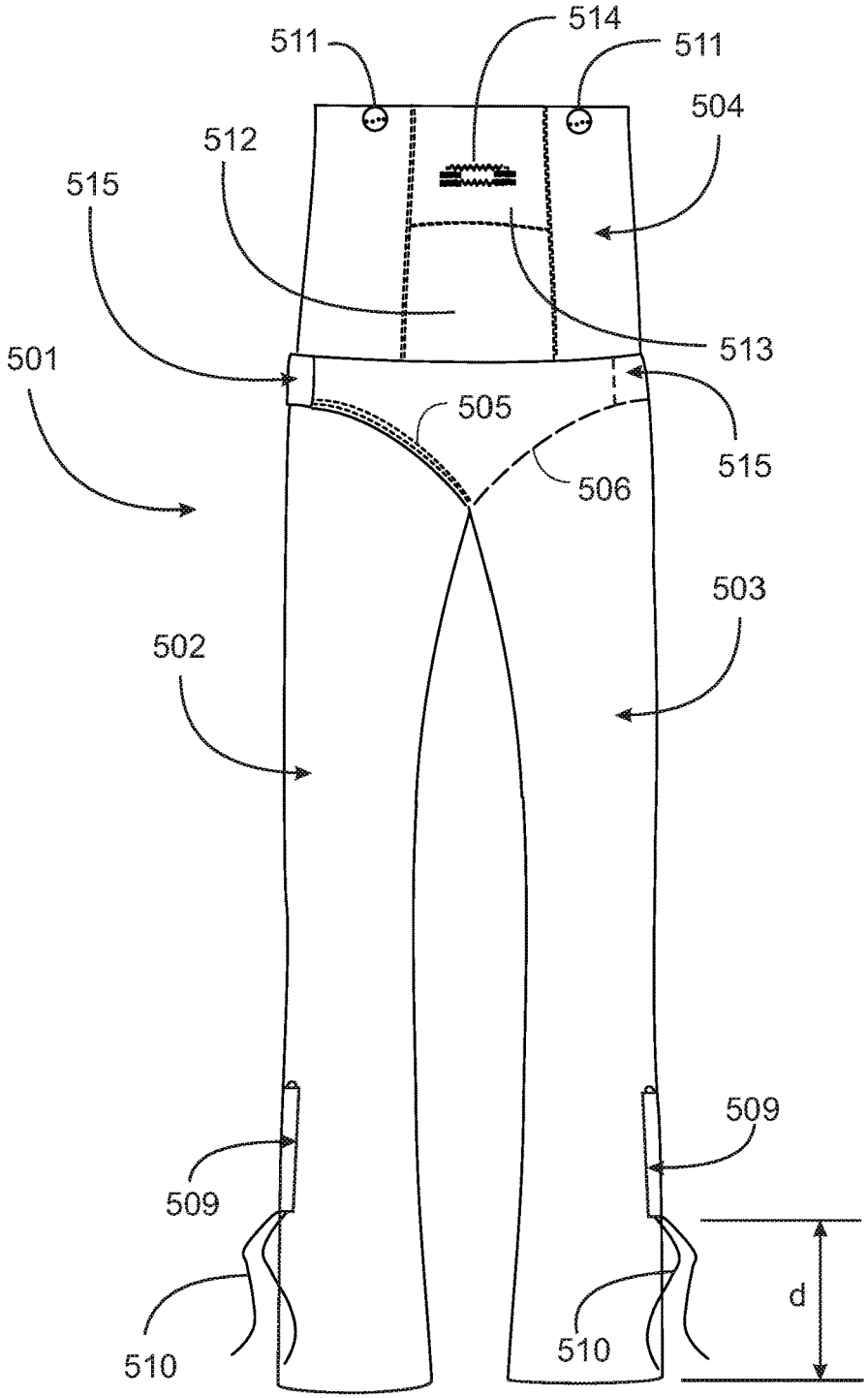
FIG. 5*a* is an elevation front view of a garment according to an embodiment of the invention.

FIG. 5*a* is an elevation front view of a garment 501 according to an embodiment of the invention, the garment having modular, substantially mirrored leg portions 502 and 503 each enclosing the full length of one of a user's legs. There is also in the garment of FIG. 5*a* an upper section 504 which may be provided as a contiguous part of portion 502, or 503, or partially by each of portions 502 and 503, or in some embodiments may be a separate portion provided to be worn in some circumstances along with garment 501.

Modular portion 503 of garment 501 is an outer portion, that is, the portion analogous to portion 101 of FIG. 2*b*, that provides the outer layer of material over the wearer's front torso and rear buttocks region. Edge 505 then, is the accessible edge that a user may first grasp and pull to the opposite side to be able to reach the hidden front edge 506 of portion 502, shown as a dotted line, which may then be grasped and pulled to expose an area of the wearer's front torso, such as the wearer's genitals. It will be apparent that edges 505 and 506 are front edges of openings that have also back edges not shown in FIG. 5*a*

Figure 5B:
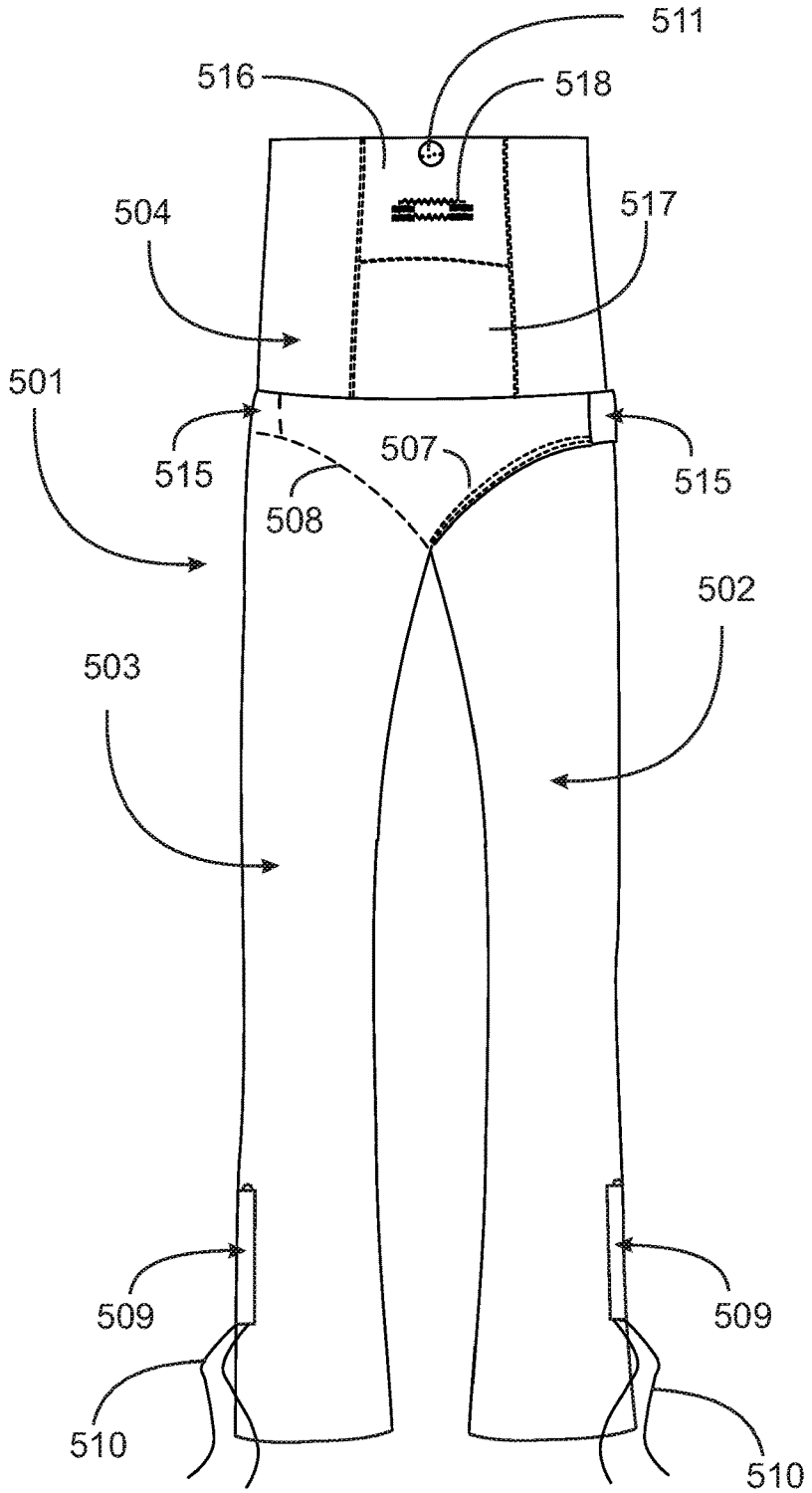
FIG. 5*b* is an elevation rear view of the garment of FIG. 5*a*.

FIG. 5*b* is a rear elevation view of garment 501 of FIG. 5*a*, so portions 502 and 503 appear reversed from their positions in FIG. 5*a*. Edge 507 is the back edge of the side opening of portion 503, of which edge 505 is the front edge. Hidden edge 508 is the back edge of the side opening of portion 502, of which edge 506 is the front edge.

As described above in regard to FIGS. 1-4, a wearer may grasp an exposed edge, pull the fabric aside to reveal a hidden edge of the portion beneath, may then grasp that edge and pull the fabric aside, to expose either the wearer's frontal torso or buttocks region, depending on whether the edges worked are in the front or the back of the garment.

Exposed edges 505 and 507 are illustrated as reinforced, which may be done in several ways. These edges in some embodiments of the invention are able to stretch substantially, and the fabric of the garment of the area above the crotch and to the side of the edge must also be a stretch material in these embodiments, so the fabric may be distorted to reach a concealed edge, and to stretch the concealed edge to expose the area of the wearer's body meant to be exposed by the wearer. In one embodiment the exposed edges, both front and back, and the concealed edges as well, are reinforced with a rubberlike material of about one-quarter inch in diameter. This is but one example, and not a limitation. This reinforcement causes the edges to follow the natural line and curve of the wearer's intersection between the upper thigh and the torso in the front.

In another embodiment of the invention a side patch, shown as element 515 in FIG. 5*a*, is implemented on both modular portions just at the hip area on the side opposite the leg portion, as shown in FIG. 5*a*. In this embodiment the material of the fabric that covers the torso area above the crotch area in both modular portions need not be as flexible and stretchable as in the embodiments without the side patch 515. This is because the side patch is made of material that is substantially stretchable with a considerable spring rate incorporating greater than 30% of a synthetic stretch fiber such as Spandex, Lycra or elastane. In this embodiment, when the wearer grasps and edge and pulls the fabric aside, it is the side patch that stretches primarily, and provides force to return the fabric to its original form when released allowing edges 201 and 203 to return to an integral cleft region on each side of vaginal area and 202 and 204 to move back to position just under the buttocks.

A side patch 515 on modular portion 502 is not seen directly in FIG. 5*a*, because it is beneath fabric of portion 503, so is shown in dotted outline.

Figure 6:
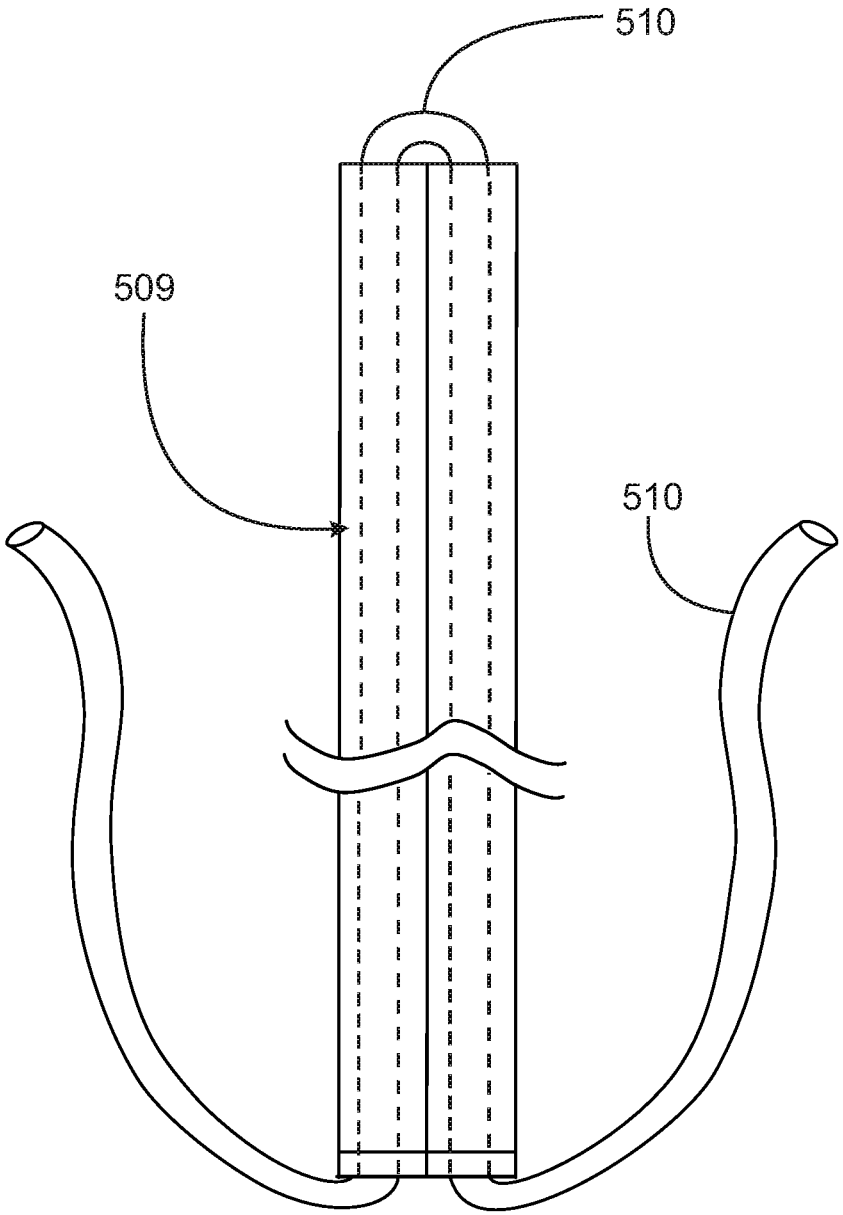
FIG. 6 is a side elevation view of an adjustment mechanism in an embodiment of the invention.

FIG. 6 is a side elevation view of an adjustment tie mechanism in an embodiment of the invention shown on the legs of the modular portions in FIG. 5*a* and FIG. 5*b*. Two fabric tubular structures are sewn side-by-side to form structure 509, which may be sewn to the outside of the leg portions, but could be anywhere about the circumference of the leg, and may be implemented at any height on the leg. In a preferred embodiment, however, the adjustment tie mechanisms are joined to the legs of the modular portions at a height "d", seen in FIG. 5*a*, that is maintained in many embodiments at from about 4 inches to about 6 inches. This structure is open at both ends at the top and bottom, and in one embodiment a cord 510 is threaded through one tubular structure 509 from below, out at the top, then down through the other tubular structure as shown, leaving a length of the cord exposed from each end at the bottom. It should be apparent that the cord in some embodiments might be threaded in from the top, rather than from the bottom.

The structure and cord allows a wearer to pull up and tie the leg to a truncated length, either at the end of the leg, or at an intermediary place along the height of the leg. The tubular structure may be of different lengths and diameter, and the cord may be of any one of a variety of different materials, and in a variety of different colors.

Figure 7B:
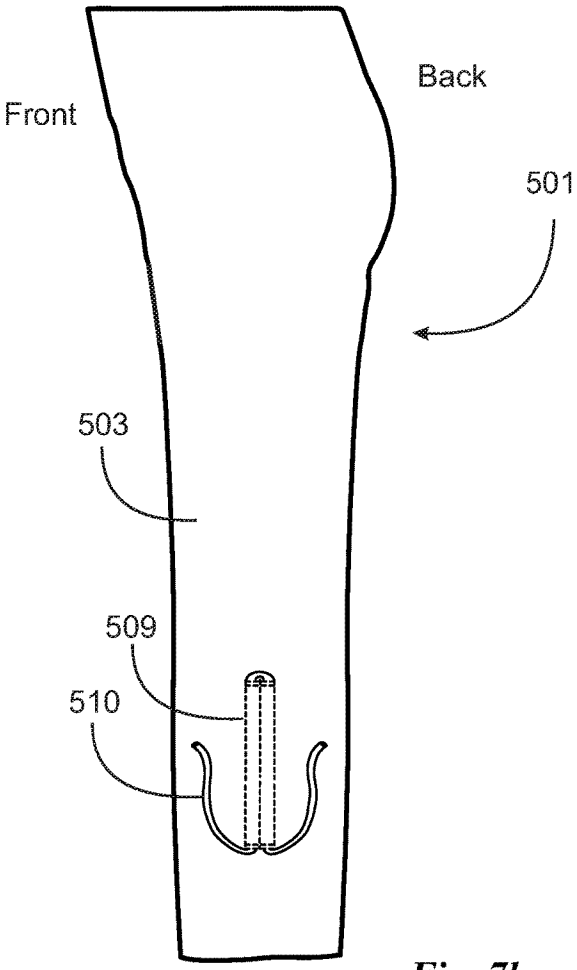
FIG. 7*b* is an elevation view of the left side of the garment of FIG. 5*a*.
Figure 7A:
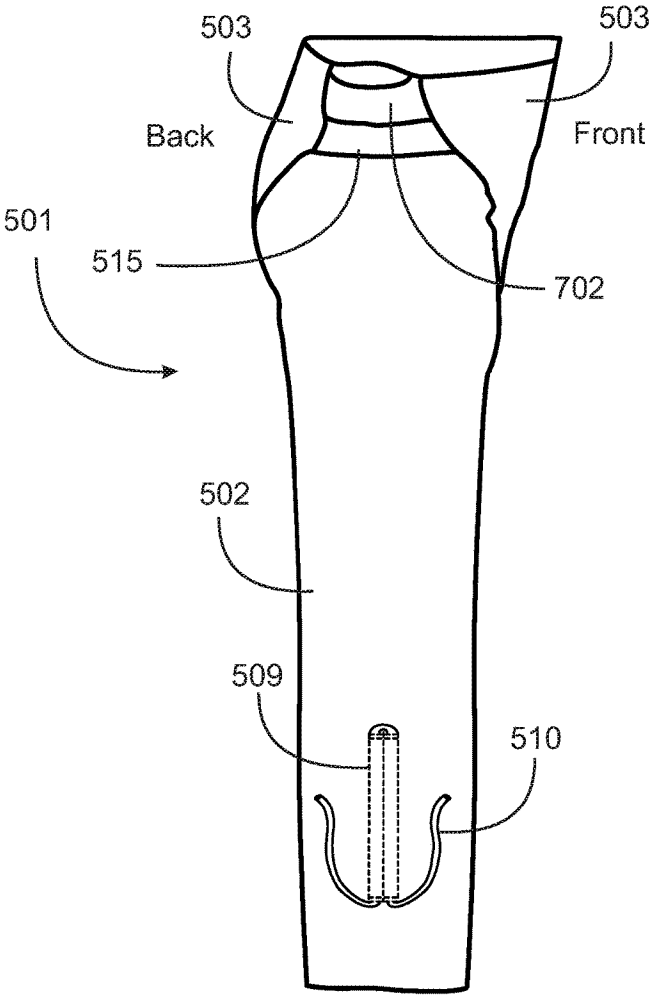
FIG. 7*a* is an elevation view of the right side of the garment of FIG. 5*a*.

FIG. 7*a* is an elevation view of the right side of the garment of FIG. 5*a*, and FIG. 7*b* is an elevation view of the left side of the garment of FIG. 5*a*. Front and back are indicated in both views. In FIG. 7*a* the leg seen from the right side is a part of modular portion 502, which may be considered the inner portion, providing hidden edges that can only be accessed after the wearer pulls the exposed edge (either front or rear) of the opposite portion 503. The exposed edges of portion 503 above the crotch area are seen in FIG. 7*a*. The adjustment tie mechanism 509/510 is illustrated in both the right and the left side views, and at the preferred height "d" shown in FIG. 5*a*. Side patch 515 is seen on the hip area, and also in this embodiment a loop element 702, which may be used for carrying a water bottle for example, or a utensil. The characteristics and functions of side patch 515 are described elsewhere in this specification.

Referring now to FIG. 7*b*, showing the left side, the fabric goes unbroken up to the waist height, because this is the outside modular portion. It will be apparent to the skilled person that outside/inside is simply a matter of choice in assembly of the two modular portions. A choice may well be made based on whether a garment is meant for a person who is right-handed or left-handed.

Figure 8:
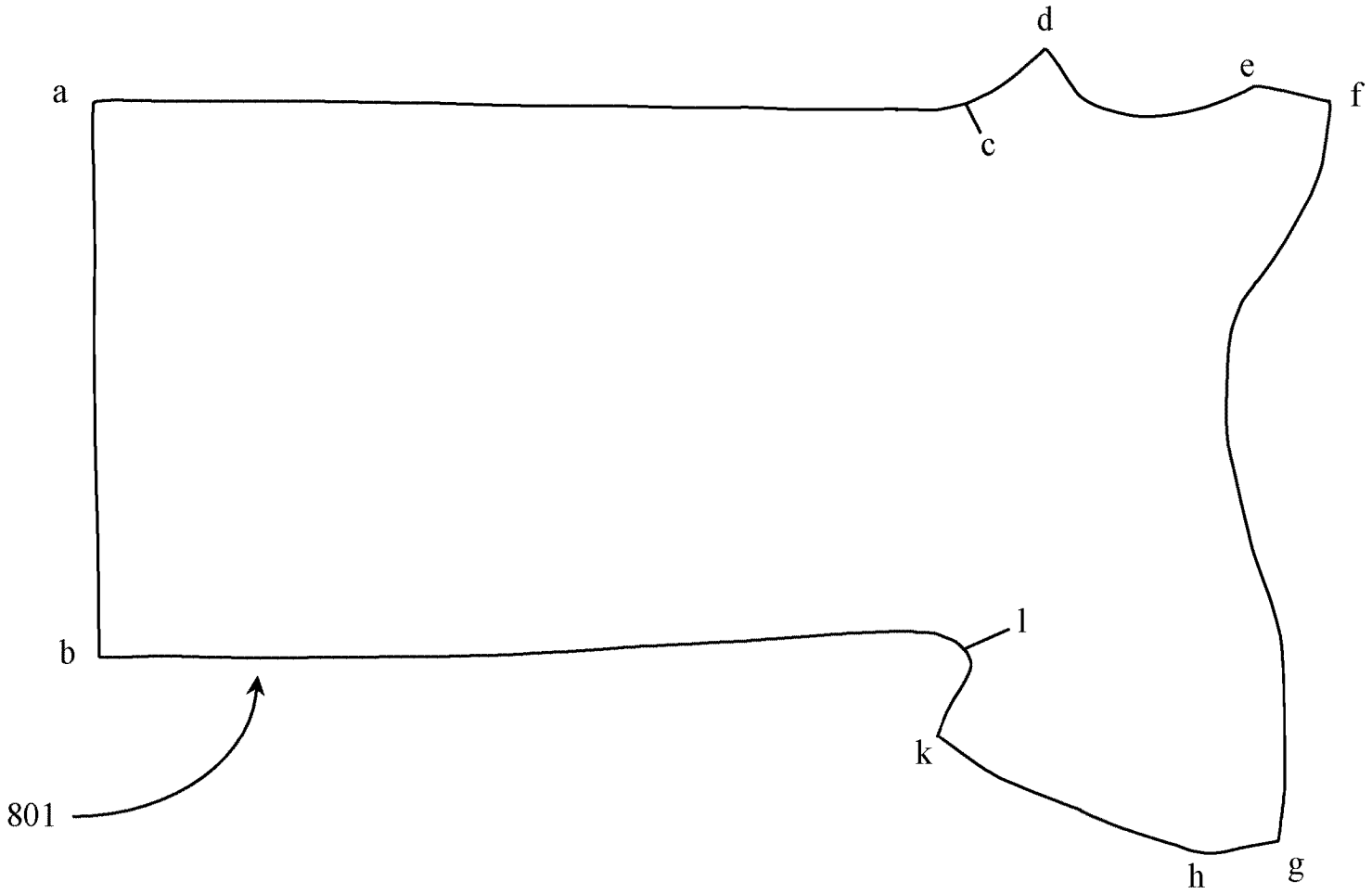
FIG. 8 is a flattened pattern of the shape and contours of a fabric panel that may be used to create either modular portion in an embodiment of the invention.

FIG. 8 is a flattened pattern of the shape and contours of a fabric panel that may be used to create either modular portion 502 or 503 in an embodiment of the invention. The edge of the fabric panel from a to b is of a length to provide the circumference of the bottom opening of the leg, at the ankle in a full-length embodiment. The leg height from the bottom opening to the crotch area is represented on one side by a to c, and on the other by b to 1. These two dimensions will be the same.

In implementing a modular portion from the fabric panel in the size and shape shown in FIG. 8, one sews edge a-d to edge b-k. The seam from a/b to c/l will be essentially straight, and the result will provide the leg covering of the modular portion. The curved portion c/l sewn to d/k provides a turn in the seam at the top, so the leg portion seam does not terminate at the side of the crotch that the leg portion serves, but at the opposite side of the crotch. This is important, as otherwise the two assembled modular portions 502 and 503 would leave an open slit across the crotch from right to left in the assembled garment. The way the seam is provided caused there to be an overlap of fabric across the crotch area in the assembled garment. An obtuse angle formed by a/c/d and an acute angle formed by b/l/k, when sewn together form a horizontal seam across lower buttocks near crotch which is very important for forming edges 201, 202, 203 and 204 allowing overlap and keeping the openings, such as 302 of FIG. 3*b* closed when not in use.

Once the seam a/b to d/k is complete, one joins edge e-f to edge h-g, and sews the two edges together, which causes edge f-g to provide the waist opening. When this is accomplished, points e and h are together and points d and k are together, so edge k-h now forms one edge of the side opening, and edge k-h forms the other edge of the side opening, through which the second of the two modular portions may be passed to assemble two portions into a single garment. In some embodiments the fabric panel is dimensioned such that the side patch 515 can be sewn in place along edges e-f and h-g.

In one embodiment edge k-h, seen to be longer than edge d-e, forms the edge of the rear covering of the torso above the crotch up to the waist, and edge d-e, seen to be shorter, forms the edge of the front covering of the torso above the crotch area up to the waist.

One may turn pattern 801 over to mark and cut a second fabric panel to be used to implement the second of the two modular portions needed to form a single garment according to the invention. In some embodiments it may be desired that there be some differences in the two modular portions, especially in the region above the crotch area, which will require a separate pattern to mark and cut the fabric panel for the second modular portion.

It is not required that the fabric panel to form one modular portion be everywhere of a same fabric, a same thickness, a same flexibility or a same stretch characteristics. To provide special features in a finished garment according to an embodiment of the invention, one may add an extra layer of material in one or more areal portions of the fabric panel, may join different kinds of material together and then mark and cut, so one part of the modular portion is an entirely different material than another part, and may add insulation material to be on the inside of one part of the modular portion, such as lining the leg portion, for example. There are many possibilities.

Figure 9:
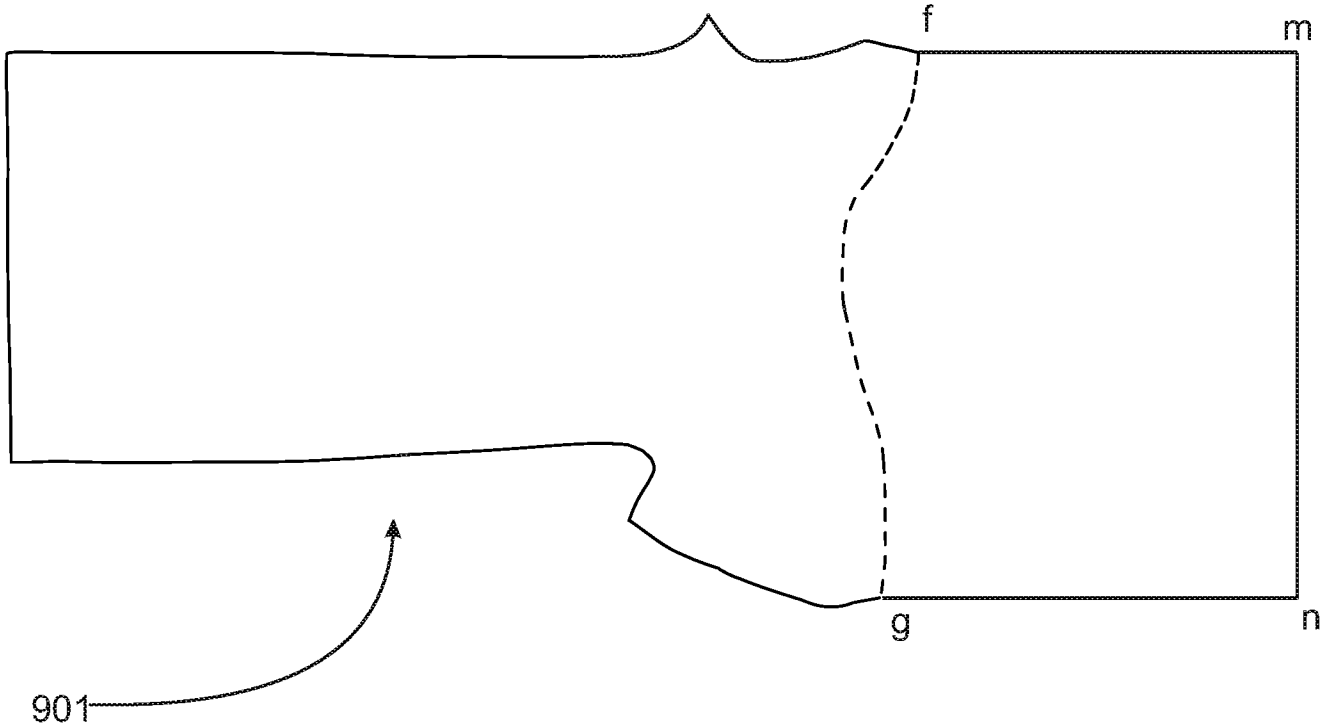
FIG. 9 shows a pattern providing an upper portion in an embodiment of the invention.

Referring again to FIGS. 5*a* and 5*b*, these figures additionally illustrate upper sections of a garment that have not as yet been described, either as to their nature, or as to how these parts might be accomplished. In FIGS. 5*a* and 5*b* the upper section is element 504, and is shown as a single unit. This may be accomplished by adding to the pattern of FIG. 8, along the edge from f to g, a new portion above the waist area. FIG. 9 shows a single example of such a pattern 901.

In FIG. 9, material has been added to the pattern, now indicated as pattern 901, from the waist line f-g up to m-n. When a fabric panel is prepared according to this pattern, and the leg edges are sewn together, the edge f-m may be similarly sewn to edge g-n, which will provide a single, tubular upper portion 504 as seen in FIGS. 5*a* and 5*b*. If the angle of f-m is changed to angle in somewhat, and the same for g-n, the upper portion may have a larger circumference at the waist than at the top, m-n.

It should be apparent to the skilled person, that an upper panel portion may be provided extending from either modular portion, simply by controlling the width and placement of the extended portion. By careful placement one may provide separate front and back extended portions, open at the sides, or many other effects.

Figure 10:
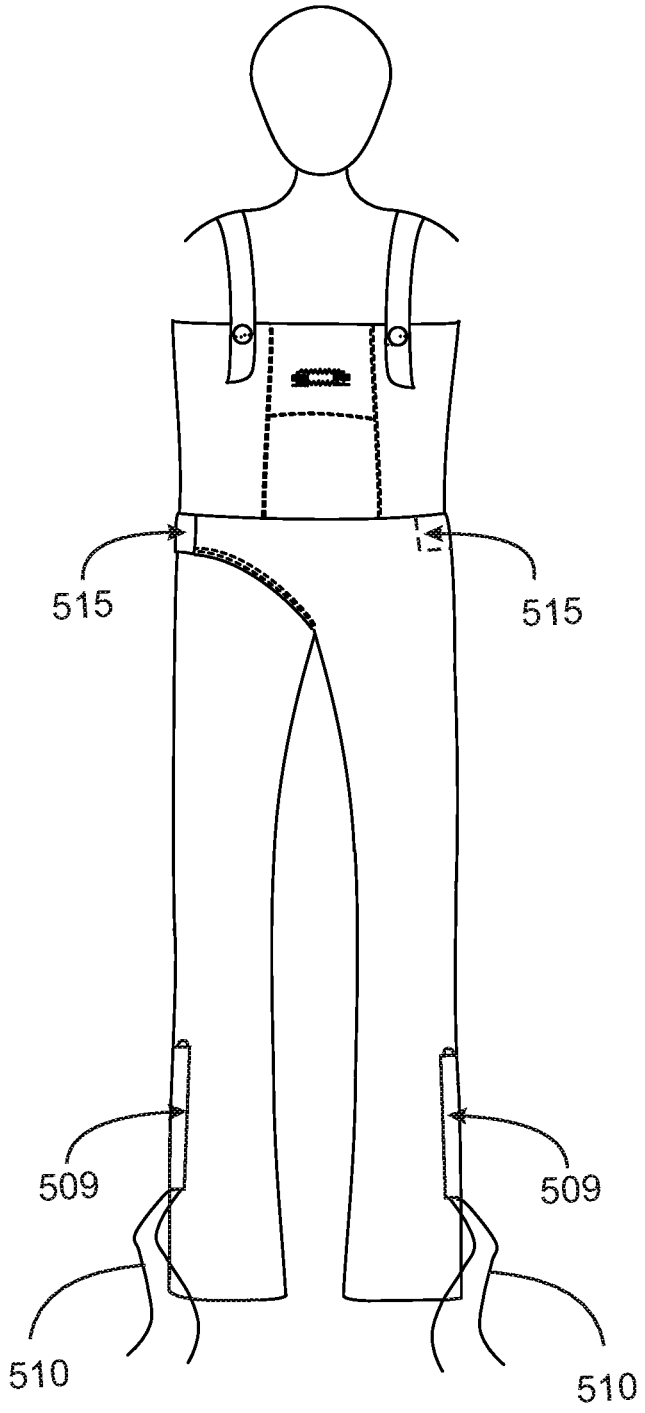
FIG. 10 shows a circumstance with buttons on the front connected to straps in an embodiment of the invention.

Referring again to FIG. 5*a*, two buttons 511 are shown added along the upper edge of the extended portion. These buttons may be used for connecting a neck strap or one or two straps that may pass over the wearer's shoulders and be buttoned to the upper portion in the back. This circumstance is shown in FIG. 10. Two pocket areas 512 and 513 are shown added as well in FIG. 5*a*, which pockets may be sewn on, or may be formed from separate layers of fabric used for the upper section. A pocket opening 514 is shown as well, and may be a zippered opening a buttoned opening, or may have no closure element. In an embodiment with no closure element, a synthetic elastic material such as the swimtape used for edges of openings may be incorporated in a seam around a pocket opening to hold items in the pocket. The pockets with elastic material and seam can actually hold items substantially larger than the pocket openings such as a water bottle, for example.

In one embodiment a pocket with an opening may be added on the inside of upper section 504, and that pocket may be accessible by pulling the upper section down over the torso section above the crotch area. In another embodiment, the upper portion my be made longer (higher) such that when pulled down will form a skirt over the torso part and an upper part of the leg sections. This circumstance is shown in FIG. 12.

Figure 12:
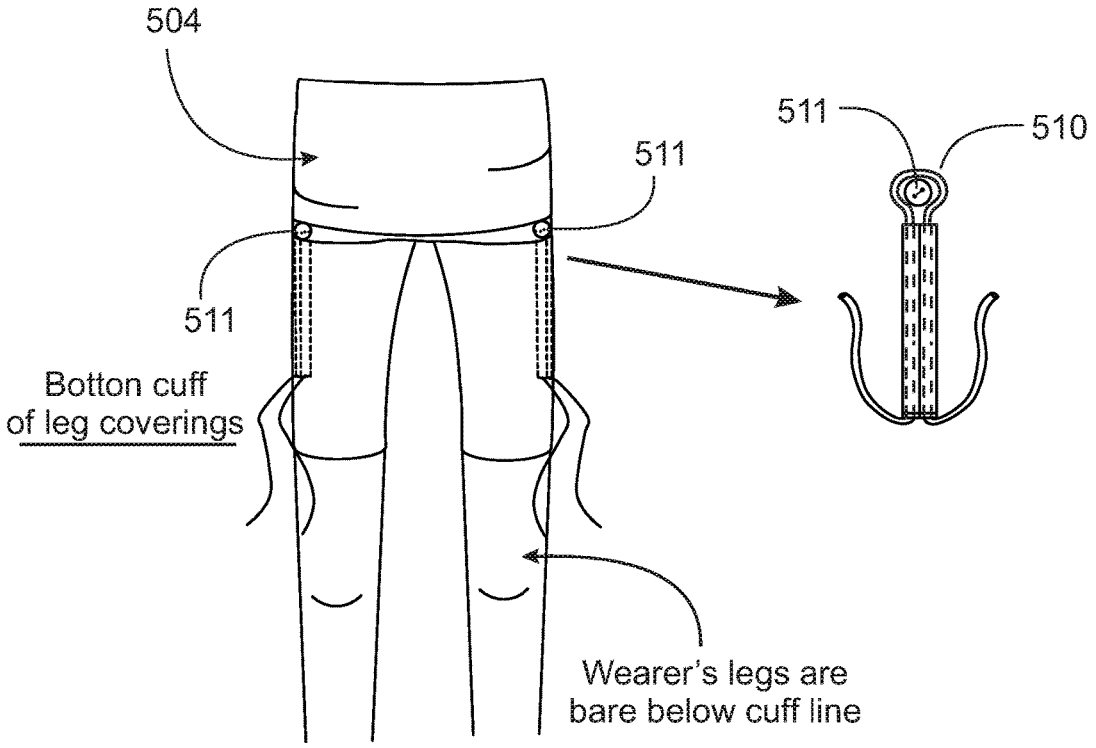
FIG. 12 shows an upper portion pulled down to act as a skirt portion in an embodiment of the invention.

FIG. 12 illustrates a garment according to an embodiment of the invention, wherein an upper portion 504 has been pulled down over the lower torso section of the garment, including at least the buttocks in back of the torso and the upper thigh of the front torso, such that buttons 511 (see FIG. 5*a*) are now at a height at or below the crotch area. In this example the adjustment tie mechanism 509 is located on the legs of the garment at the preferred height of from 4 to 6 inches, and the wearer pulls the tie mechanisms, and thus the pant legs up to place the loop of cord 510 at the height of buttons 511. Under this circumstance the wearer may loop cords 510 over buttons 511 and secure the pulled-down section 504 to the legs of the garment, with the legs of the garment raised as shown in FIG. 12, leaving the wearer's legs bare below the height of the cuff with the legs drawn up. The joining of the cord of the tie mechanism to the buttons is shown to the right in FIG. 12 as a magnified view.

Figure 11:
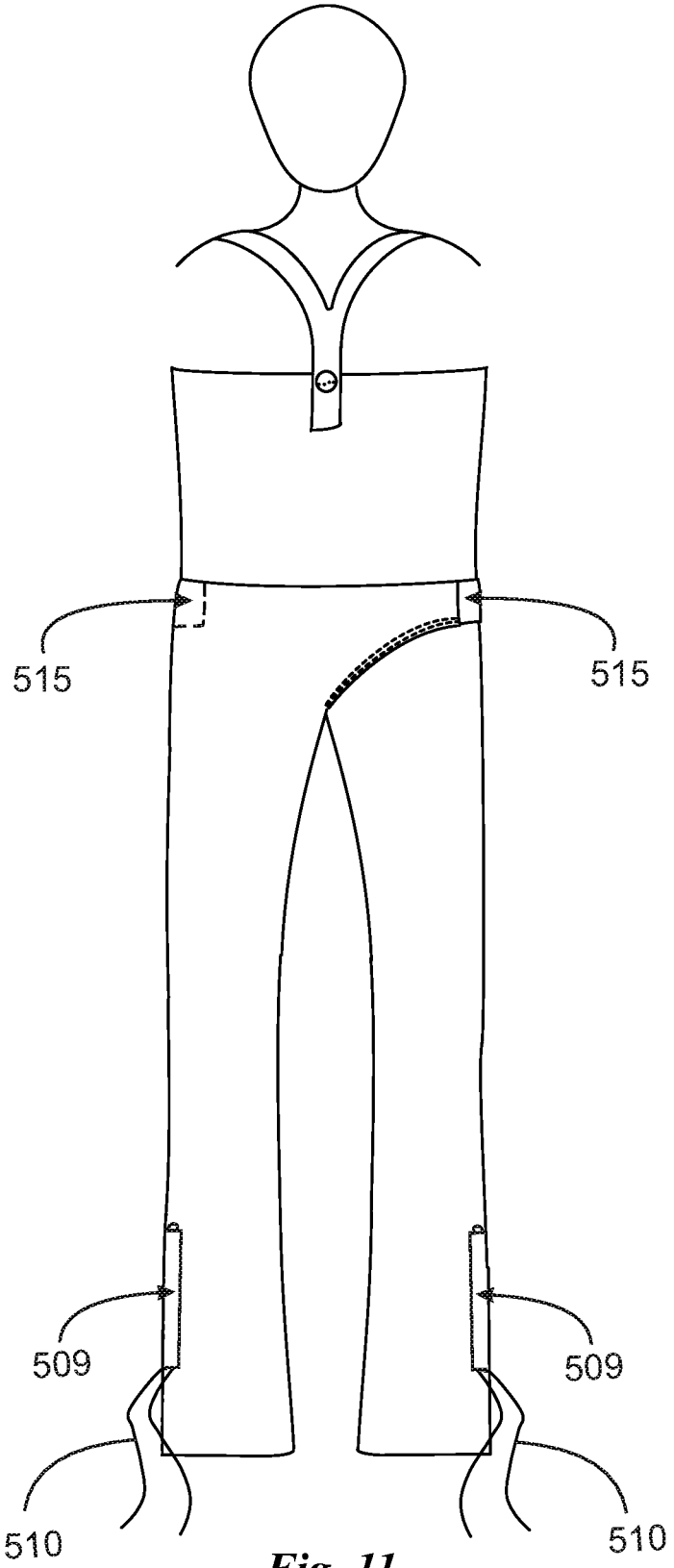
FIG. 11 shows an upper section from the back with a single button in an embodiment of the invention.

In FIG. 5*b* a single button 511 is shown about midway along the upper edge of the upper portion. This button may be used to connect commonly two straps from the buttons on the front, the straps passing over the wearer's shoulders. This circumstance is shown in FIG. 11. Additional pockets 516 and 517 may be added as well, and a pocket opening 518 analogous to 514 of FIG. 5*a*. It will be apparent that pockets may be added in many different ways for many different purposes.

It will be apparent to the skilled person that there are many alterations and modifications that may be made in different embodiments of the invention without departing from the clear scope of the invention. Many differences in material, characteristics of material, structure, and so on, have been described in the specification with regard to the drawing figures, and many more are possible. The scope and breadth of the invention is limited only by the language of the claims.

The invention claimed is:

1. A garment comprising:

a first modular portion having a substantially tubular first leg enclosure on a first side from a lowermost end up to a crotch position, a first torso portion contiguous with the first leg enclosure, the first torso portion having first front and back regions proceeding upward from the crotch position to a continuous waist circumference, providing a first waist opening, with the first front and back regions ending at first front and back edges at an angle from the crotch position up to just below the waist height, the first front and back edges forming a first side opening from the torso region above the crotch position; and a second modular portion essentially a mirror image of the first modular portion, having a substantially tubular second leg enclosure on a second side from a lowermost end up to the crotch position, a second torso portion contiguous with the second leg enclosure, the second torso portion having second front and back regions proceeding upward from the crotch position to a continuous waist circumference, providing a second waist opening, with the second front and back regions ending at second front and back edges at an angle from the crotch position up to just below the waist height, the second front and back edges forming a second side opening from the torso region above the crotch position;

wherein the first modular portion, juxtaposed with the second modular portion by passing the first modular portion down through the second waist opening and the first leg enclosure through the second side opening with the first torso portion inside the second torso portion, aligning the first waist opening inside the second waist opening, provides the garment with leg enclosures for both of a wearer's legs, with a combined torso portion with the second front and back edges of the second side opening exposed, and the first front and back edges of the first side opening covered beneath fabric of the second torso region, enabling the wearer to grasp and pull the exposed second front edge in a first direction toward the first side opening to an extent to expose and grasp a part of the first front edge, and then to pull the first front edge in the opposite direction from the first direction to an extent to then expose a region of the wearers lower torso, and to also enable the wearer to grasp the exposed second back edge and to pull the exposed second back edge toward the first side opening to an extent to expose and grasp a part of the first back edge, and then to pull the first back edge in the opposite direction to an extent to then expose a region of the wearers crotch or buttocks area.

2. The garment of claim 1 wherein the modular portions are not joined, and are worn as separate juxtaposed portions.

3. The garment of claim 1 wherein the modular portions, juxtaposed, are joined along the waist circumference.

4. The garment of claim 1 wherein the leg enclosures are full length to about the position of the wearer's ankles.

5. The garment of claim 4 further comprising an adjustment tie structure joined to one or both of the leg enclosures, the tie structure comprising two side-by-side tubular portions with a cord passing upward through one of the tubular structures, out the top, and down through the other tubular structure, providing a mechanism enabling the wearer to pull up the leg enclosures to a desired height, and to tie the cord to secure the leg enclosures to the wearer's legs.

6. The garment of claim 5 wherein the adjustment tie structures are joined to the leg enclosures at a height of from about 4 inches to about 6 inches above the lowermost extremity of the leg enclosures.

7. The garment of claim 1 wherein the leg enclosures are truncated less than the full length of a wearer's legs.

8. The garment of claim 1 wherein one or both of the modular portions comprise side patches of stretchable material at a wearer's hip in the waist portions, such that pulling the front and back edges of a side opening of a torso section having the side patch, stretches primarily the side patch, and the stretch of the side patch provides force for pulling the front and back edges back their original position when released.

9. The garment of claim 5 further comprising an upper portion extending upward from the waist portion of one or both of the modular portions, the upper portion providing coverage for part of the wearer's torso above the waist are.

10. The garment of claim 9 wherein the upper portion is contiguous with just one of the modular portions, and provides just a front covering for the wearer's upper torso, leaving the wearer's back exposed.

11. The garment of claim 9 wherein the upper portion is contiguous with just one of the modular portions, and provides a front and a back covering for the wearer's upper torso.

12. The garment of claim 9 wherein separate front and back portions are provided by extensions from one or both of the modular portions.

13. The garment of claim 9 wherein the upper portion further comprises one or more pockets with openings for access to the pockets.

14. The garment of claim 9 wherein the upper portion further comprises one or more buttons proximate a top edge.

15. The garment of claim 9 wherein the upper portion is folded down at the waist height to cover the wearer's lower torso region including at least the buttocks in back of the torso and the upper thigh of the front torso, and the legs are pulled up by the tie mechanisms, with the cord of the tie mechanisms looped over the buttons of the folded-down upper portion and tied, leaving the legs shortened by the distance the tie mechanisms are pulled up.

* * * * *